US006563265B1

(12) United States Patent
Sivaraman et al.

(10) Patent No.: US 6,563,265 B1
(45) Date of Patent: May 13, 2003

(54) APPLYING PREALLOYED POWDERS AS CONDUCTING MEMBERS TO ARC TUBES

(75) Inventors: Karthik Sivaraman, Mayfield Village, OH (US); Curtis Edward Scott, Mentor, OH (US); Martin L. Panchula, University Heights, OH (US)

(73) Assignee: General Electric Company, Schenectady, NY (US)

( * ) Notice: Subject to any disclaimer, the term of this patent is extended or adjusted under 35 U.S.C. 154(b) by 17 days.

(21) Appl. No.: 09/707,412

(22) Filed: Nov. 6, 2000

(51) Int. Cl.[7] ..... H01K 1/50

(52) U.S. Cl. ..... 313/567; 313/594; 313/601; 313/607; 313/234

(58) Field of Search ..... 313/567, 594, 313/601, 607, 234; 252/505, 513

(56) References Cited

U.S. PATENT DOCUMENTS

| | | | | |
|---|---|---|---|---|
| 3,424,935 A | | 1/1969 | Gungle et al. | |
| 3,828,214 A | | 8/1974 | Keeffe et al. | |
| 4,048,539 A | | 9/1977 | Walker et al. | |
| 4,053,809 A | | 10/1977 | Fridrich et al. | |
| 4,568,859 A | | 2/1986 | Houkes et al. | |
| 4,633,135 A | | 12/1986 | Akins | |
| 4,727,294 A | | 2/1988 | Houkes et al. | |
| 4,788,475 A | | 11/1988 | Jacobs | |
| 4,940,923 A | | 7/1990 | Kroontje et al. | |
| 5,047,693 A | | 9/1991 | Roberts et al. | |
| 5,059,868 A | | 10/1991 | El-Hamamsy et al. | |
| 5,355,053 A | | 10/1994 | Zhu | |
| 5,541,480 A | | 7/1996 | Renardus et al. | |
| 5,757,137 A | | 5/1998 | Zhu | |
| 5,932,055 A | * | 8/1999 | Newell et al. | 156/245 |
| 5,994,823 A | | 11/1999 | Okamura et al. | |

OTHER PUBLICATIONS

Waymouth and Kusko, Monographs in Modern Electrical Technology (1971), Electric Discharge Lamps.

Nortup, Krasko and Lou, Journal of the Illuminating Engineering Society (Summer 1996), Pulse Start of Metal Halide Lamps for Improved Lumen Maintenance.

Byszewski and Budinger, Journal of the Illuminating Engineering Society (Summer 1990), Enhanced Starting of HID Lamps.

Wyner, Journal of the IES (Apr., 1979), Electrolysis of Sodium Through Alumina Arc Tubes.

Gregor, Li, Budinger and Byszewski, Journal of the Illuminating Engineering Society (Summer, 1996), Arc Tube Transparency Loss Due to Starting of HID Lamps.

Waymouth, Koury, Gungle and Peterson, Illuminating Engineering (Apr., 1967), Sodium Loss Processes in Metal Iodide Arc Lamps.

Cohen, Gungle, Gutta, Olson and Richardson, Journal of IES (Jul., 1974), Heat Starting a High–Pressure Sodium Lamp.

Collins and McVey, Lighting Design & Application (Sep., 1975), HPS Lamps for Use on HPM Ballasts.

Illuminating Engineering Society of North America Lighting Handbook, Eighth Edition, High–Intensity Discharge Lamps, p. 219.

* cited by examiner

*Primary Examiner*—Robert H. Kim
*Assistant Examiner*—Elizabeth Gemmell
(74) *Attorney, Agent, or Firm*—Fay, Sharpe, Fagan, Minnich & McKee, LLP

(57) ABSTRACT

An arc discharge lamp comprising an arc tube including a starting aid is provided. The starting aid comprises at least one prealloyed powder bound to the surface of the arc tube.

10 Claims, 1 Drawing Sheet

APPLYING PREALLOYED POWDERS AS CONDUCTING MEMBERS TO ARC TUBES

BACKGROUND OF THE INVENTION

The present invention relates generally to lighting, and more specifically to an arc discharge lamp, such as a ceramic metal halide lamp. This invention relates particularly to a novel conducting material and means for applying that material to high pressure arc discharge lamp tubes, e.g., sodium arc tubes(HPS).

Discharge lamps produce light by ionizing a fill such as a mixture of metal halides and mercury with an electric arc passing between two electrodes. The electrodes and the fill are sealed within a translucent or transparent discharge chamber which maintains the pressure of the energized fill material and allows the emitted light to pass there-through. The fill, also known as a "dose" emits a desired spectral energy distribution in response to being excited by the electric arc. However, arc discharge lamps, particularly those of a high pressure variety, are often difficult to start.

Presently known metallic starting aids for discharge lamps include those composed of tungsten metal to reduce the required electrical breakdown voltage for starting. Unfortunately, they may not survive the usual air firing step used for cleaning ceramic arc tubes. The tungsten oxidizes and becomes useless as a starting aid. A similar oxidation problem prevents application of metallic starting aids on arc tubes intended for open air operation, such as ceramic or quartz mercury arc tubes for light projectors. Another problem with these metallic starting aids is that tungsten is relatively expensive. However, lower cost metals have higher vapor pressure, which, in the vacuum established within the outer envelope of HPS lamps, would evaporate to produce bulb darkening and lumen depreciation.

Previous HPS starting aids have been designed in the form of a wire or coiled ignition filament. The starting aid is positioned in contact with the outer surface of the arc tube and is connected to one electrical power lead of the lamp. When an arc is formed and the lamp begins to warm up, power is either removed from the starting aid, or the starting aid is moved away from the arc tube, so as to prevent electric field accelerated sodium diffusion through the arc tube wall. Such sodium diffusion would adversely affect the lamp life. One drawback to this method for applying an external conducting member to HPS arc tubes is the cost and complexity of designing lamps with movable starting aids. Furthermore, in the absence of direct attachment to the lamp, the starting aid may sag away from the arc tube due to the high temperature of operation. Additionally, these switches are typically attached to the lamp frame, resulting in heating by radiation, rather than conduction. This results in variation of lamp performance depending on the wattage of different lamps.

It would therefore be desirable to find a novel material and means for applying that material as an external conducting member to arc tubes which would overcome the above mentioned problems.

SUMMARY OF THE INVENTION

The present invention provides an arc discharge lamp comprising an arc tube including a starting aid. The starting aid comprises an alloy bound to the surface of the arc tube. Preferred materials include cobalt and nickel inclusive alloys. Also preferred are high temperature cobalt and nickel based super alloys.

In another embodiment of the present invention, a method for forming an arc discharge lamp is provided. This method comprises depositing a prealloyed powder on the surface of an arc tube and heating the arc tube to a temperature in excess of the solidus temperature of the prealloyed powder to bind the alloy to the arc tube.

In a further embodiment of the present invention, a high pressure sodium lamp is provided. The high pressure sodium lamp comprises an outer bulb; with first and second discharge devices within said outer bulb connected electrically in series, each discharge device including a discharge vessel enclosing a discharge space and an ionizable filling; first and second discharge electrode assemblies within said discharge space each including an electrode portion on which a discharge arc terminates during normal lamp operation and a current conductor portion extending to the exterior of said discharge vessel; means for electrically connecting said first electrode assembly of each discharge device to a source of electric potential outside of said lamp envelope; and a starting aid including at least one alloy having a solidus temperature above about 1000° C. bound to the surface of said arc tube.

DETAILED DESCRIPTION OF THE INVENTION

Figure 1:
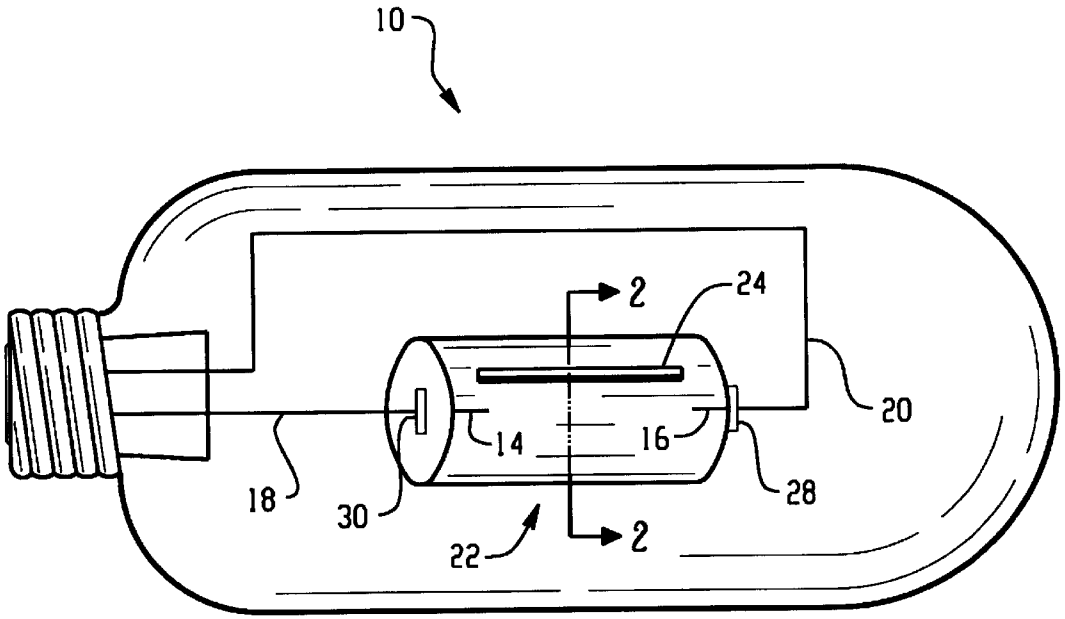
FIG. 1 illustrates a light source including a ceramic discharge chamber with a starting aid according to an exemplary embodiment of the present invention.

Referring now to FIG. 1, a discharge lamp 10, such as a high pressure sodium lamp, according to an exemplary embodiment of the present invention is depicted. The discharge lamp 10 includes a discharge chamber 12 which houses two electrodes 14, 16, and a fill (not shown). The electrodes 14, 16 are connected to conductors 18, 20 which apply a potential difference across the electrodes. In operation, the electrodes 14, 16 produce an arc which ionizes the fill in discharge chamber 12. The emission characteristics of the light produced by the plasma depend primarily on the constituents of the fill material, the voltage across the electrodes, the temperature distribution of the chamber, the pressure in the chamber, and the geometry of the chamber. For a ceramic metal halide lamp, the fill material typically comprises a mixture of mercury, a rare gas, such as argon or xenon, and a metal halide such as NaI, $ThI_3$, or $DyI_3$. Of course, other examples of fills are well known in the art.

As shown in FIG. 1, the discharge chamber 12 comprises a central body portion 22 which is coated with the starting aid 24. The ends of electrodes 14, 16 are typically located near the opposite ends of the body portion 22. The electrodes are connected to a power supply by the conductors 18, 20, which are disposed through each seal 28, 30. The electrodes typically comprise tungsten. The conductors typically comprise molybdenum and niobium, the latter having a thermal expansion coefficient close to that of the ceramic (usually alumina) used to construct the discharge chamber to reduce thermally induced stresses on the seals 28, 30.

The discharge chamber 12 is sealed at the ends of the body portion with seal members 28, 30. Seal members 28, 30 typically comprise a disposium-alumina silica glass and can be formed as a glass frit in the shape of a ring around one of the conductors, e.g. 18, and aligned vertically with the discharge chamber 12, and melted to flow down over the conductor 18 and form a seal between the conductor 18 and the body portion 22. The discharge chamber is then turned upside down to seal the other end of the body portion 22 after being filled with the dose.

The starting aid of the present invention is in the form of a layer 24 bound to the body of the discharge tube 22. The layer is preferably in the form of a strip from end region to end region of the discharge tube. The layer serves as a starting aid and extends substantially between the main electrodes 14, 16. Moreover, the metal layer 24 provides a dimensionally closer arc which facilitates starting.

Figure 2:
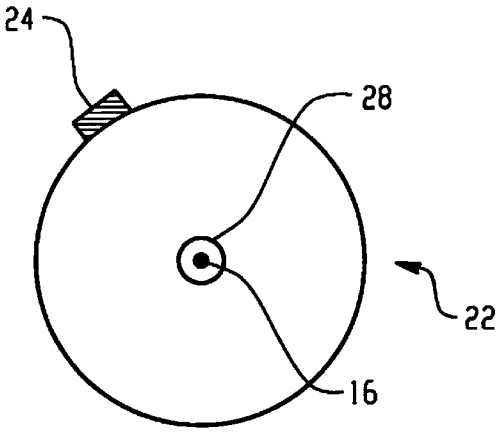
FIG. 2 illustrates a cross section of the discharge body 22 shown in FIG. 1.

With reference to FIG. 2, a cross section of the body of the discharge chamber 22 is shown. An electrode 16 is located near the end of the body 22 and the seal 28 is shown behind and around the electrode 16. The starting aid 24 is shown as a coating on the surface of the body 22.

The body of the discharge chamber 22 can be constructed by forming a mixture of ceramic powder and a binder into a solid cylinder. Typically, the mixture comprises about 95–98 weight % ceramic powder and about 2–5 weight % organic binder. The ceramic powder may comprise alumina, $Al_2O_3$ (having a purity of at least 99.98%) in a surface area of about 2–10 meters$^2$ per gram. The alumina powder may be doped with magnesia to inhibit grain growth, for example, an amount equal to about 0.03% to about 0.2%, preferably 0.05% by weight of the alumina. Other ceramic materials which may be used include nonreactive refractory oxides and oxynitrides such as yttrium, aluminum, garnet, aluminum oxynitride, and aluminum nitride. Binders which may be used individually or in combination of organic polymers are polyols, polyvinyl alcohol, vinylacetates, acrylates, cellulosics, and polyethers. Subsequent to die pressing, the binder is removed from the green part typically by a thermal-treatment, to form a bisque fired part. Thermal treatment may be conducted, for example, by heating the green part in air from room temperature to a maximum temperature, form about 980–1100° C. over 4 to 8 hours, then holding the maximum temperature for 1 to 5 hours, followed by cooling the part. After thermal treatment, the porosity of the bisque fired part is typically about 30–60%, more typically about 40–50%.

While the invention has been described with reference to ceramic arc tubes, it should be noted that the present invention would by equally applicable to discharge lamps with quartz arc tubes as well as to both single crystal and polycrystalline alumina arc tubes.

After the arc tube has been sintered, the starting aid coating is bound to the surface of the arc tube. In the present invention, the starting aids are preferably prealloyed powders with conducting capabilities. These prealloyed powders, such as cobalt and nickel based alloys, when heated above the solidus temperature will partially melt and bond with the polycrystalline or single crystal alumina. The presence of a two-phase solid plus liquid region prevents the powders from slumping, and eliminates the need for a seal glass for bonding purposes.

Exemplary prealloyed powders suitable for use as starting aids in the present invention may be selected from the group consisting of nickel, cobalt, boron, silicon, and mixtures thereof. The preferred prealloyed powders will have a solidus temperature greater than 1000° C., preferably greater than 1100° C., and most preferably greater than 1200° C. Furthermore, the prealloyed powders will have a solidus temperature below about 1300° C. to facilitate their application.

The conducting component of the present invention, the prealloyed powders, is preferably applied to the presintered or fully sintered ceramic arc tube as a paste, which is then melted, allowing the component alloy to bond to the surface of the arc tube. A typical paste may be comprised of an organic vehicle (e.g. methyl ethyl ketone). Exemplary commercially available pastes include DURAMAX® available from Rohm & Haas.

Preferably, the alloy coating will cover no more than about 3% of the surface area of the arc tube. Furthermore, the conducting alloy will preferably form a coating on the surface of the arc tube which is between about 0.01 and 1,000 $\mu$m in thickness, more preferably between about 0.1 and 500 $\mu$m, most preferably between about 01. and 100 $\mu$m thick.

Lamps of the present invention contain conductive starting aids which are capable of surviving an air firing step for arc tube cleaning, such as temperatures exceeding 750° C. for several minutes, preferably more than about 30 minutes, most preferably more than about 60 minutes to remove organic surface contaminants. Preferably, the starting aids can survive thousands of hours of operation in air, preferably greater than about 2,000 hours, most preferably greater than about 10,000 hours.

The present invention has been described with reference to the preferred embodiments. Various changes and modifications will be apparent to one skilled in the art. It is intended that the invention be construed as including all such modifications and alterations insofar as they come within the scope of the appended claims or the equivalents thereof.

We claim:

1. An arc discharge lamp comprising an arc tube including a starting aid, said starting aid comprising at least one alloy having a solidus temperature above about 1000° C. bound to the surface of said arc tube.

2. The lamp of claim 1 wherein said alloy has a solidus temperature below about 1300° C.

3. The lamp of claim 1 wherein said alloy has a solidus temperature greater than about 1200° C.

4. The lamp of claim 1 wherein said alloy is conducting.

5. The lamp of claim 4 wherein said alloy is selected from the group consisting of cobalt and nickel based alloys, and mixtures thereof.

6. The lamp of claim 1 wherein said arc tubes are single crystal or polycrystalline alumina.

7. The lamp of claim 1 wherein said alloy has a two-phase solid plus liquid region.

8. The lamp of claim 1 wherein said alloy forms a conducting pattern on the exterior of the arc tube.

9. The lamp of claim 1 wherein said arc discharge lamp comprises a high pressure sodium lamp.

10. A high pressure sodium lamp comprising an outer bulb; first and second discharge devices within said outer bulb connected electrically in series, each discharge device including a discharge vessel enclosing a discharge space and an ionizable filling; first and second discharge electrode assemblies within said discharge space each including an electrode portion on which a discharge arc terminates during normal lamp operation and a current conductor portion extending to the exterior of said discharge vessel; means for electrically connecting said first electrode assembly of each discharge device to a source of electric potential outside of said lamp envelope; and a starting aid comprising at least one alloy having a solidus temperature above about 1000° C. bound to the surface of said arc tube.

* * * * *